US005666869A

United States Patent [19]

Sakamoto et al.

[11] Patent Number: 5,666,869

[45] Date of Patent: Sep. 16, 1997

[54] TIP PAPER CUTTING APPARATUS FOR A FILTER CIGARETTE MANUFACTURING SYSTEM

[75] Inventors: Hiroshi Sakamoto; Takayuki Irikura, both of Tokyo, Japan

[73] Assignee: Japan Tobacco Inc., Tokyo, Japan

[21] Appl. No.: 410,722

[22] Filed: Mar. 29, 1995

[30] Foreign Application Priority Data

Mar. 31, 1994 [JP] Japan ..... 6-063708

[51] Int. Cl.[6] ..... B26D 7/08

[52] U.S. Cl. ..... 83/168; 83/169

[58] Field of Search ..... 83/168, 169, 101; 156/281, 389

[56] References Cited

U.S. PATENT DOCUMENTS

| | | | |
|---|---|---|---|
| 1,338,157 | 4/1920 | Rains | 83/168 |
| 1,944,577 | 1/1934 | Rose | 83/169 |
| 2,722,245 | 11/1955 | Clampitt | 83/169 |
| 3,240,243 | 3/1966 | Golick | 83/169 |
| 4,091,580 | 5/1978 | Oates | 83/169 |

FOREIGN PATENT DOCUMENTS

| | | |
|---|---|---|
| 3918137 | 12/1989 | Germany . |
| 785417 | 10/1957 | United Kingdom . |
| 2137549 | 10/1984 | United Kingdom . |

*Primary Examiner*—Kenneth E. Peterson
*Assistant Examiner*—Sean A. Pryor
*Attorney, Agent, or Firm*—Birch, Stewart, Kolasch & Birch, LLP

[57] ABSTRACT

A tip paper cutting apparatus for a filter cigarette manufacturing system includes a pair of brush rollers arranged close to a bladed drum, and a brush is mounted on the outer peripheral surface of each brush roller so as to be in contact with cutting blades of the bladed drum. Olive oil is atomized by compressed air in a spraying device, and supplied to passages formed within the brush rollers. Olive oil is then sprayed toward the brushes from spray ports of the passages opening in the outer peripheral surfaces of the brush rollers so as to pass through the brushes. Accordingly, even when the brush rollers are rotating at high speed, the brushes can be sufficiently soaked with olive oil passing therethrough. As a result, the cutting blades are reliably applied with olive oil by means of the brushes, and good cutting quality of the blades can be maintained.

17 Claims, 6 Drawing Sheets

TIP PAPER CUTTING APPARATUS FOR A FILTER CIGARETTE MANUFACTURING SYSTEM

BACKGROUND OF THE INVENTION

1. Field of the Invention

The present invention relates to a filter attachment machine for a filter cigarette manufacturing system, and more particularly, to a tip paper cutting apparatus incorporated in the filter attachment machine.

2. Description of the Related Art

In recent years tobacco with mild taste has been in demand. To meet the demand, filter cigarettes each having a filter at one end of a cigarette are on the market. Filters are attached to respective cigarettes in a filter attachment machine of a cigarette manufacturing system, by wrapping a piece of tip paper around a cigarette and a filter. To this end, typically a wrapping section provided in the filter attachment machine is supplied with filter plugs each interposed between two cigarettes, as well as pieces of tip paper applied with paste.

In connection with the supply of pieces of tip paper applied with paste, the filter attachment machine has a transport path for guiding the tip paper unrolled from a paper roll to the wrapping section, and a paste applicator is arranged so as to face the transport path for applying paste to one side of the tip paper. On the downstream side of the paste applicator, a cutting apparatus is arranged for cutting the tip paper, which has been applied with paste, into pieces with a predetermined length. Also, a heater is arranged on the upstream side of the paste applicator for heating the one side of the tip paper to be applied with paste prior to the paste applying step, and a predrier is arranged on the downstream side of the paste applicator for heating the opposite side, or the non-paste side, of the tip paper to dry the paste applied to the tip paper by means of heat conducted to the paste from the tip paper.

The pieces of tip paper cut by the cutting apparatus are supplied to the wrapping section, where each piece of tip paper is wrapped around two cigarettes with a filter plug therebetween. Double-length filter cigarettes obtained in this manner, each connected by a piece of tip paper, are cut in the center of the filter plug, thereby obtaining individual filter cigarettes.

The cutting apparatus mentioned above generally comprises a receiving drum for attracting the tip paper by means of negative pressure, and a bladed drum facing the receiving drum and rotated in a direction opposite to that of the receiving drum. The bladed drum has cutting blades mounted thereon close to the receiving drum. The tip paper applied with paste is fed in between the receiving drum and the bladed drum, with the paste-applied surface thereof facing the bladed drum, and cut into pieces by the cutting blades as the two drums rotate.

Accordingly, when the tip paper is cut, the cutting blades come into contact with the paste-applied surface of the tip paper, whereas the paste applied to the tip paper has considerable adhesive strength, though it has been predried in the preceding step. Thus, after repeated cutting operation, the cutting blades are encrusted with paste and the cutting quality thereof lowers. To eliminate this, for example, a repellent liquid such as olive oil is sprayed on the brush of a rotatable brush roller arranged in the vicinity of the bladed drum, and olive oil is applied to the cutting blades by means of the brush.

However, since olive oil scatters from the brush due to the centrifugal force caused by rotation of the brush roller, the brush cannot retain sufficient olive oil, and thus the cutting blades may be insufficiently applied with olive oil. In such cases, incrustation of paste cannot be satisfactorily prevented, lowering the cutting quality of the blades. If the tip paper cutting becomes defective due to the lowering of the cutting quality of the blades, the tip paper is consumed wastefully. Also, to remove the paste incrustation from the cutting blades, the operation of the cigarette manufacturing system must be stopped, lowering the productivity.

To eliminate the inconvenience, a greater amount of olive oil may be sprayed. In this case, however, the amount of olive oil scattered from the brush also greatly increases, which leads to increased consumption of olive oil. Since olive oil is expensive, the cost of manufacturing cigarettes also increases. Further, olive oil scattered from the brush to surrounding parts damages the quality of cigarette products, and also brings about even lower productivity because the parts surrounding the brush must be cleaned more frequently. This disadvantage is noticeable particularly in a high-speed cigarette manufacturing system since the brush roller rotates at high speed.

SUMMARY OF THE INVENTION

An object of the present invention is to provide a tip paper cutting apparatus capable of reliably applying a paste repellent liquid to cutting blades and thereby maintaining good cutting quality of the blades.

According to the present invention, there is provided a tip paper cutting apparatus for a filter cigarette manufacturing system in which tip paper fed in between a receiving drum and a bladed drum rotating in opposite directions is cut into pieces by cutting blades arranged on an outer peripheral surface of the bladed drum. The tip paper cutting apparatus comprises brush roller means including a brush roller rotatably arranged close to the bladed drum and having an outer peripheral surface, and a brush mounted on the outer peripheral surface of the brush roller so as to be in contact with the cutting blades, the brush roller means including a passage formed therein having a plurality of discharge ports opening in the outer peripheral surface of the brush roller, the passage of the brush roller means being supplied with a paste repellent liquid.

The advantage of the tip paper cutting apparatus of the present invention resides in that the paste repellent liquid is discharged from the passage in the brush roller toward the brush in such a manner that the paste repellent liquid is forcibly passed through the brush while being scattered in the radially outward direction of the brush roller due to the centrifugal force caused by rotation of the brush roller. Accordingly, even when the brush roller is rotating at high speed, the brush can be sufficiently soaked with the paste repellent liquid and the cutting blades of the bladed drum can be reliably applied with the paste repellent liquid by the brush.

Consequently, the cutting blades are prevented from being encrusted with paste, thus maintaining good cutting quality of the blades. This serves to greatly reduce the possibility of defective supply of the tip paper and thus the frequency of suspensions of the cigarette manufacturing system attributable to defective supply of the tip paper. Therefore, the tip paper is not consumed wastefully and the productivity of the cigarette manufacturing system is improved.

Preferably, the tip paper cutting apparatus includes supply means for supplying the paste repellent liquid to the passage of the brush roller means. The supply means includes atomizing means for atomizing the paste repellent liquid before the paste repellent liquid is discharged from the plurality of discharge ports of the passage of the brush roller means. In this preferred embodiment, atomized paste repellent liquid passes through the brush, whereby the brush is sufficiently soaked with the paste repellent liquid.

The brush roller means preferably includes a pair of brush rollers located adjacent to each other. These brush rollers are rotated in respective inward directions such that as the brush rollers rotate, corresponding portions of the peripheral surfaces of the brush rollers approach each other on one side thereof close to the bladed drum with respect to an imaginary plane containing both of the axes of rotation of the brush rollers. According to this preferred embodiment, the paste repellent liquid flies from each brush roller toward the bladed drum or the other brush roller when scattered radially outward from the outer peripheral surface region of the brush roller close to the bladed drum, thus optimizing the scattering direction of the paste repellent liquid.

Preferably, the tip paper cutting apparatus further comprises recovery means for collecting the paste repellent liquid scattered from the brush with rotation of the brush roller. In this preferred embodiment, the paste repellent liquid which was not applied to the cutting blades is collected for reuse; therefore, the consumption of the paste repellent liquid, and thus the manufacturing cost of cigarettes, can be cut down.

The above and other objects, features, and advantages of the present invention will become apparent from the following description when taken in conjunction with the accompanying drawings which illustrate preferred embodiments of the present invention by way of example.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
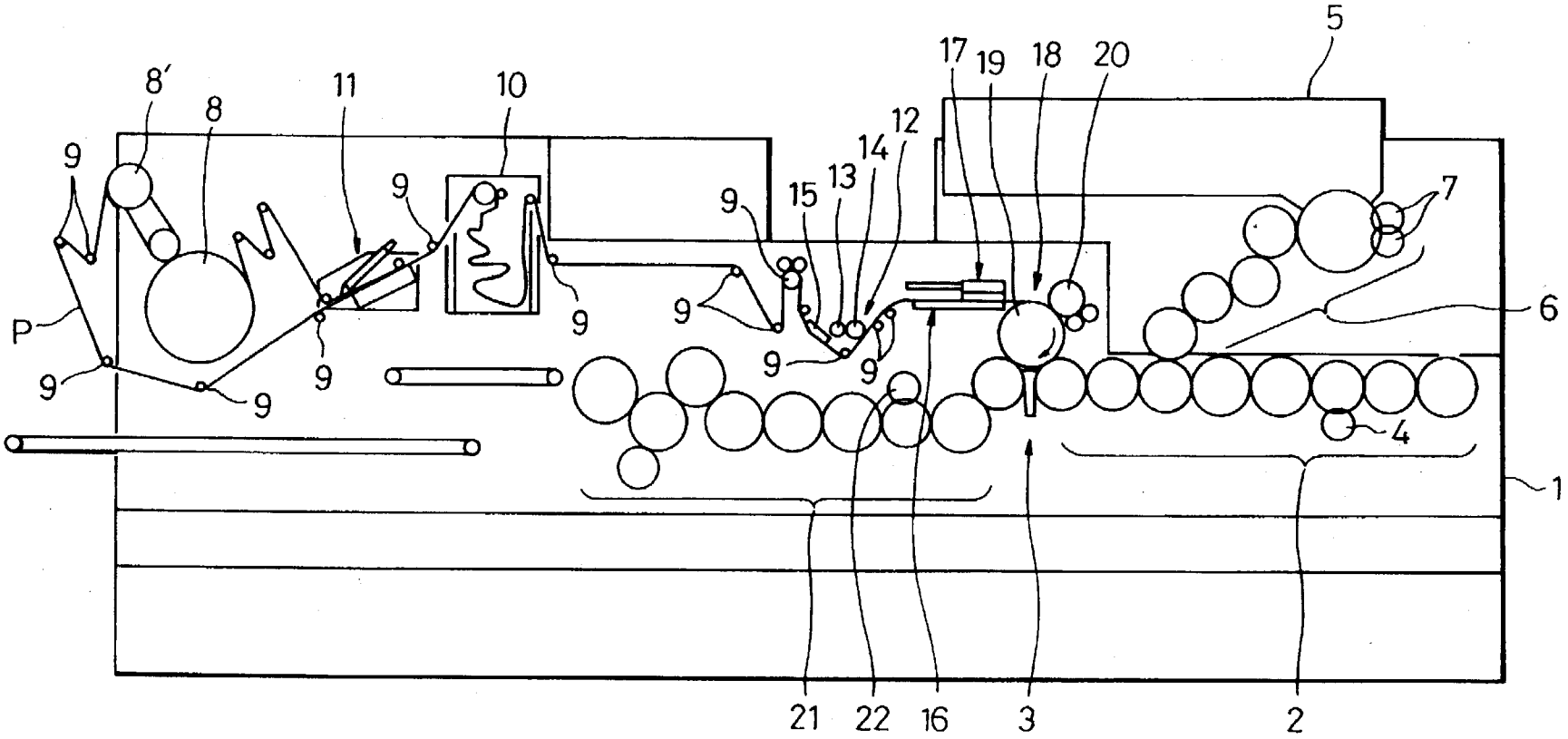
FIG. 1 is a schematic front view of a filter attachment machine of a filter cigarette manufacturing system equipped with a tip paper cutting apparatus according to one embodiment of the present invention.

Referring to FIG. 1, a filter attachment machine of a filter cigarette manufacturing system comprises a base frame 1. A drum train 2 composed of a large number of drums is arranged on the right-hand part of the base frame 1 as viewed in FIG. 1. Each of the drums has a number of grooves formed in the outer peripheral surface thereof at an equal distance from each other. A drum located at the upstream end of the drum train 2 adjoins a cigarette forming machine (not shown) of the cigarette manufacturing system, and cigarette rods produced by the cigarette forming machine, each having a length twice that of a cigarette, are fed into the respective grooves of the drum at the upstream end. The grooves of each drum are connected to a negative pressure generator through control valves, though not illustrated, so that negative attracting force is selectively produced in the individual grooves.

As the drums forming the drum train 2 rotate, cigarette rods fed to the drum at the upstream end are transported by a large number of intermediate drums and a drum located at the downstream end, toward a wrapping section 3 of the filter attachment machine. In this case, the negative attracting force is intermittently produced in the grooves of the individual drums at suitable timing. Due to the intermittent application of the attracting force and the rotation of the drums, cigarette rods are transferred from one drum to another adjacent thereto, that is, from the grooves of an upstream drum to those of a downstream drum.

Figure 2:
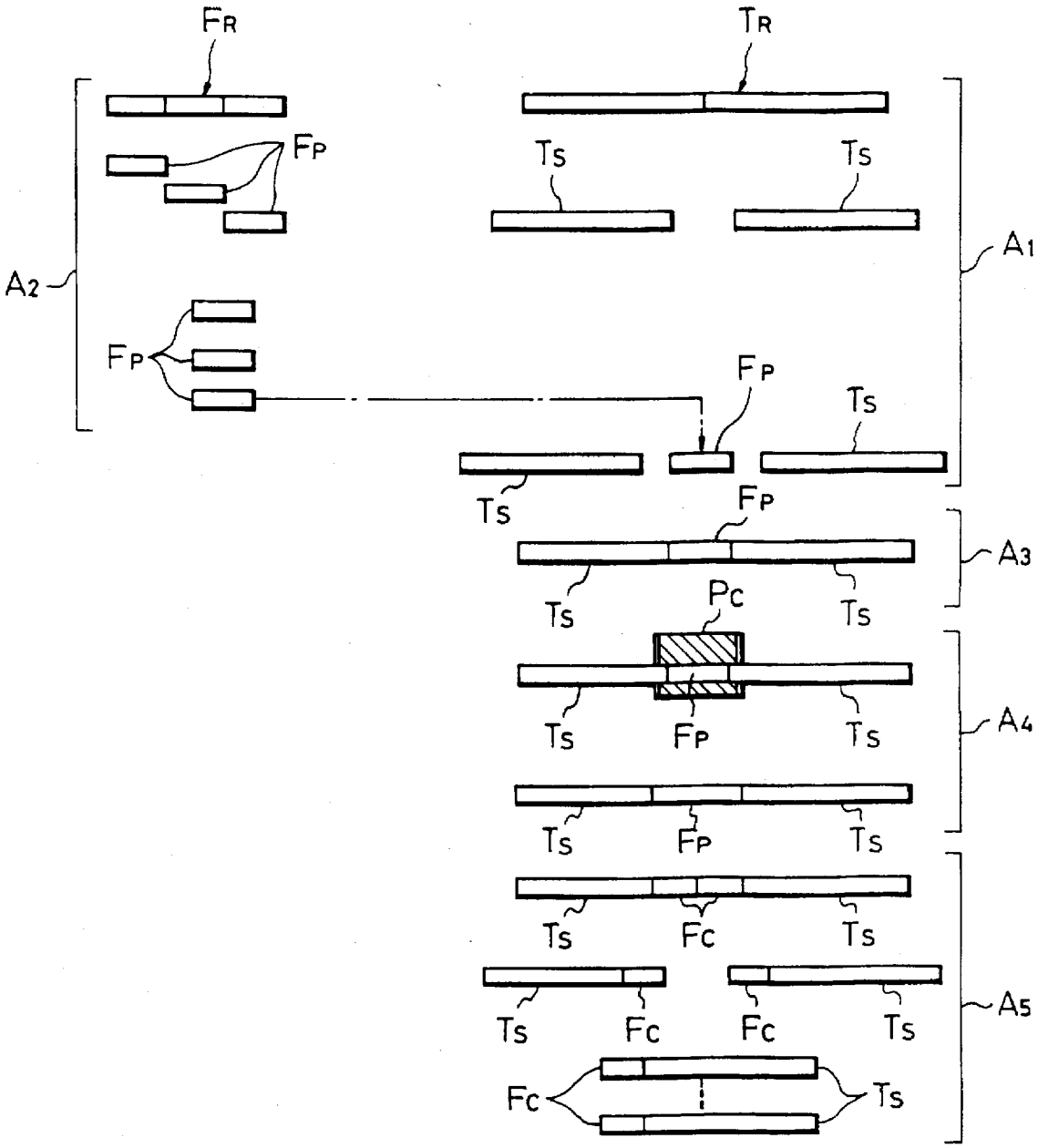
FIG. 2 is a schematic diagram illustrating a sequence of processes performed on cigarettes and filter rods in the filter attachment machine shown in FIG. 1.

While cigarette rods are transported toward the wrapping section 3 in this manner, each cigarette rod $T_R$ is cut into two equal parts, as shown in part $A_1$ of FIG. 2, by a rotary knife 4 facing one of the intermediate drums, thus obtaining two cigarettes $T_S$. Further, the two cigarettes $T_S$ are set apart from each other to provide a predetermined space therebetween while they are transported toward the wrapping section 3.

Referring again to FIG. 1, a hopper 5 is arranged above the drum train 2 and contains a large number of filter rods. A drum train 6 similar to the drum train 2 extends between the hopper 5 and an intermediate drum of the drum train 2 located more downstream than the intermediate drum facing the rotary knife 4.

Filter rods $F_R$ are fed from the hopper 5 into the grooves of a drum located at the upstream end of the drum train 6, and as this drum rotates, each filter rod $F_R$ is cut into, for example, three equal parts, by two rotary knives 7 facing the drum, thus obtaining three filter plugs $F_p$ with a predetermined length, as shown in part $A_2$ of FIG. 2. The filter plug $F_p$ has a length twice that of a filter chip connected to each cigarette $T_S$. The three filter plugs $F_p$ are then arranged in line in the direction of transportation of filter plugs by an intermediate drum in the drum train 6 serving as a grading drum, and transported toward the drum at the downstream end of the drum train 6.

As shown at the bottom of part $A_1$ in FIG. 2, the filter plugs $F_p$ are fed one by one from the drum located at the downstream end of the drum train 6. Each filter plug $F_p$ is placed between two cigarettes $T_S$, which have already been received in the corresponding groove of the associated intermediate drum in the drum train 2 with space therebetween, such that the filter plug is in alignment with the two cigarettes. The filter plug $F_p$ is then transported, together with the corresponding two cigarettes $T_S$, toward the wrapping section 3 by the drum train 2. The two cigarettes $T_S$ are moved toward each other on the drum located at the downstream end of the drum train 2 such that they are in close contact with the opposite ends of the filter plug $F_p$, as shown in part $A_3$ of FIG. 2. Accordingly, when the wrapping section 3 is supplied with filter plugs $F_p$ and cigarettes $T_S$ from the drum train 2, each filter plug $F_p$ is interposed between the corresponding two cigarettes $T_S$.

The filter attachment machine is further provided with a tip paper feeder for supplying paste-applied pieces of tip paper to the wrapping section 3. In FIG. 1, the feeder extends from the upper left end of the base frame 1 to the wrapping section 3, and has a pair of rolls 8 and 8' on each of which continuous tip paper P is wound. The tip paper P has a width sufficiently greater than the length of the filter plug $F_p$.

The tip paper feeder includes a large number of guide rollers 9 defining a tip paper feed path extending from the rolls 8, 8' to the wrapping section 3 and a storage section 10 arranged halfway in the feed path, and the tip paper P unrolled from the roll 8 or 8' (in FIG. 1, roll 8') is guided toward the wrapping section 3 by the guide rollers 9. The storage section 10 temporarily stores the tip paper P, in order to absorb the difference between the speed of feeding tip paper pieces at the wrapping section 3 and the speed at which the tip paper P is unrolled from the roll 8 or 8'.

Further, the tip paper feeder has a connecting section 11 arranged on the upstream side of the storage section 10 for connecting ends of the tip paper P. To the connecting section 11 is previously introduced the leading end of the tip paper P from that roll (in FIG. 1, roll 8) which is not currently supplying tip paper. When the trailing end of the tip paper P from the other roll (in FIG. 1, roll 8') which is currently supplying tip paper reaches the connecting section 11, the supply of tip paper from the roll 8' is stopped, and the trailing end of tip paper P from the roll 8' is connected to the leading end of tip paper P from the other roll 8. While the tip paper connection is carried out in this manner, tip paper is fed from the storage section 10, thus permitting continuous supply of tip paper to the wrapping section 3.

The filter attachment machine further includes a paste applicator 12 arranged in the middle of the feed path for the tip paper P. The paste applicator 12 is composed of a paste supply roller 13 and a paste transfer roller 14 which is disposed in rolling contact with the paste supply roller 13 and the tip paper P. Thus, paste supplied to the paste supply roller 13 is transferred to the paste transfer roller 14 with the thickness thereof controlled to a predetermined thickness, and then applied to one side surface of the tip paper P from the paste transfer roller 14.

A preheater 15 and a postheater 16 are arranged on immediately upstream side and downstream side, respectively, of the paste applicator 12. As seen from FIG. 1, the preheater 15 heats the surface of the tip paper P to which paste is to be applied, whereas the postheater 16 heats the opposite surface, or the non-paste surface, of the tip paper P. Accordingly, the surface of the tip paper to which paste is to be applied can be effectively dried in advance.

At the downstream end of the feed path of the tip paper P is arranged a cutting apparatus 18 for cutting the tip paper P, which has been applied with paste, into pieces with a predetermined length. The cutting apparatus 18 is composed mainly of a receiving drum 19 having an outer peripheral surface serving as a suction surface to which negative pressure is applied, and a bladed drum unit 20 arranged in the vicinity of the receiving drum 19. The drum 19 and the unit 20 are rotatable in opposite directions but at the same peripheral speed. Although not shown in FIG. 1, cutting blades are arranged on the outer peripheral surface of the bladed drum unit 20 at an equal distance from each other in the circumferential direction thereof.

Accordingly, when the tip paper P applied with paste reaches the receiving drum 19, the surface of the tip paper P opposite to the paste-applied surface is attracted by suction to the outer peripheral surface of the receiving drum 19. As the receiving drum 19 rotates, the tip paper P thus attracted to the outer peripheral surface of the receiving drum 19 is cut into pieces by the cutting blades of the bladed drum unit 20. Then, as the receiving drum 19 rotates, the cut pieces of tip paper are supplied toward the wrapping section 3 which adjoins both the receiving drum 19 and the drum located at the downstream end of the drum train 2.

Thereafter, as shown in part $A_4$ of FIG. 2, each piece $P_C$ of tip paper supplied to the wrapping section 3 is wrapped around and pasted to the filter plug $F_p$ and the two cigarettes $T_S$ associated therewith, which are simultaneously supplied from the drum train 2, in such a manner that the tip paper piece $P_C$ covers the entire surface of the filter plug $F_p$ and the inner end portions of the two cigarettes $T_S$ adjoining the filter plug $F_p$. In part $A_4$ of FIG. 2, the paste-applied surface of the tip paper piece $P_C$ is indicated by hatching.

In the wrapping section 3, the two cigarettes $T_S$ and the filter plug $F_p$ interposed therebetween, supplied from the drum train 2, are caused to roll between the wrapping section 3 and the receiving drum 19, and during this rolling step, the tip paper piece $P_C$ is wound around the filter plug $F_p$ and the inner end portions of the cigarettes $T_S$. As a result, the two cigarettes and the filter plug are connected together, as shown in part $A_4$ of FIG. 2, thus obtaining a continuous double-length filter cigarette.

Double-length filter cigarettes are then supplied to a drum located at the upstream end of a drum train 21, which is composed of a number of grooved drums and extends to the left in FIG. 1. In the process of transportation on the drums of the drum train 21, the double-length filter cigarettes are each cut in the center of the filter plug by a rotary knife 22 facing an intermediate drum of the drum train 21, thus obtaining individual filter cigarettes (see part $A_5$ of FIG. 2). Then, as shown in part $A_5$ of FIG. 2, the individual filter cigarettes are oriented in one direction, transferred to a conveyor, and then supplied to a subsequent packaging machine (not shown) by the conveyor. In FIG. 2, $F_C$ represents a filter chip obtained by cutting the filter plug $F_p$ into two.

Referring now to FIGS. 3 through 6, the cutting apparatus 18 outlined above with reference to FIG. 1 will be explained in detail.

As mentioned above, the receiving drum 19 and bladed drum unit 20 of the cutting apparatus 18 are rotated in opposite directions to cut the tip paper P by means of the cutting blades 44 of the drum unit 20.

In connection with this cutting function, the cutting apparatus 18 has a supporting plate 24 (FIG. 3) rotatably supporting the receiving drum 19 in cooperation with the base frame 1. The supporting plate 24 extends parallel with the base frame 1 and has an upper end securely fixed to the base frame 1 through a supporting block 25. A protuberance 24*a* integrally protrudes from one side of an intermediate portion of the supporting plate 24.

The receiving drum 19 has a drum shaft 23 (FIG. 3), the opposite ends of which are pivotally supported by the base frame 1 and the lower end portion of the supporting plate 24, respectively. One end of the drum shaft 23 is coupled to a drive mechanism (not shown). Accordingly, when the drum shaft 23 is rotated by the drive mechanism, the receiving drum 19 rotates in a predetermined direction.

Figure 3:
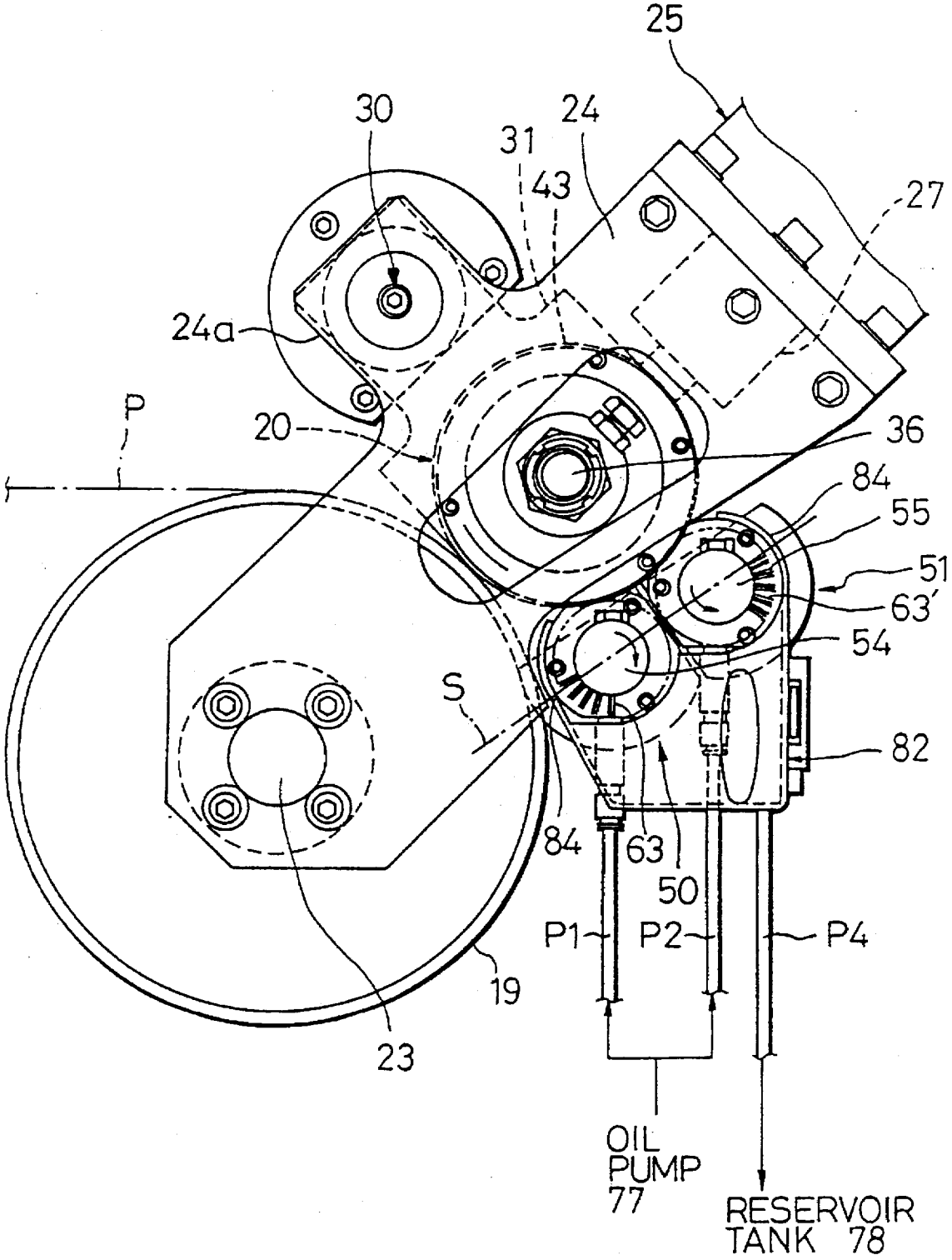
FIG. 3 is a front view of a principal part of the tip paper cutting apparatus shown in FIG. 1.
Figure 4:
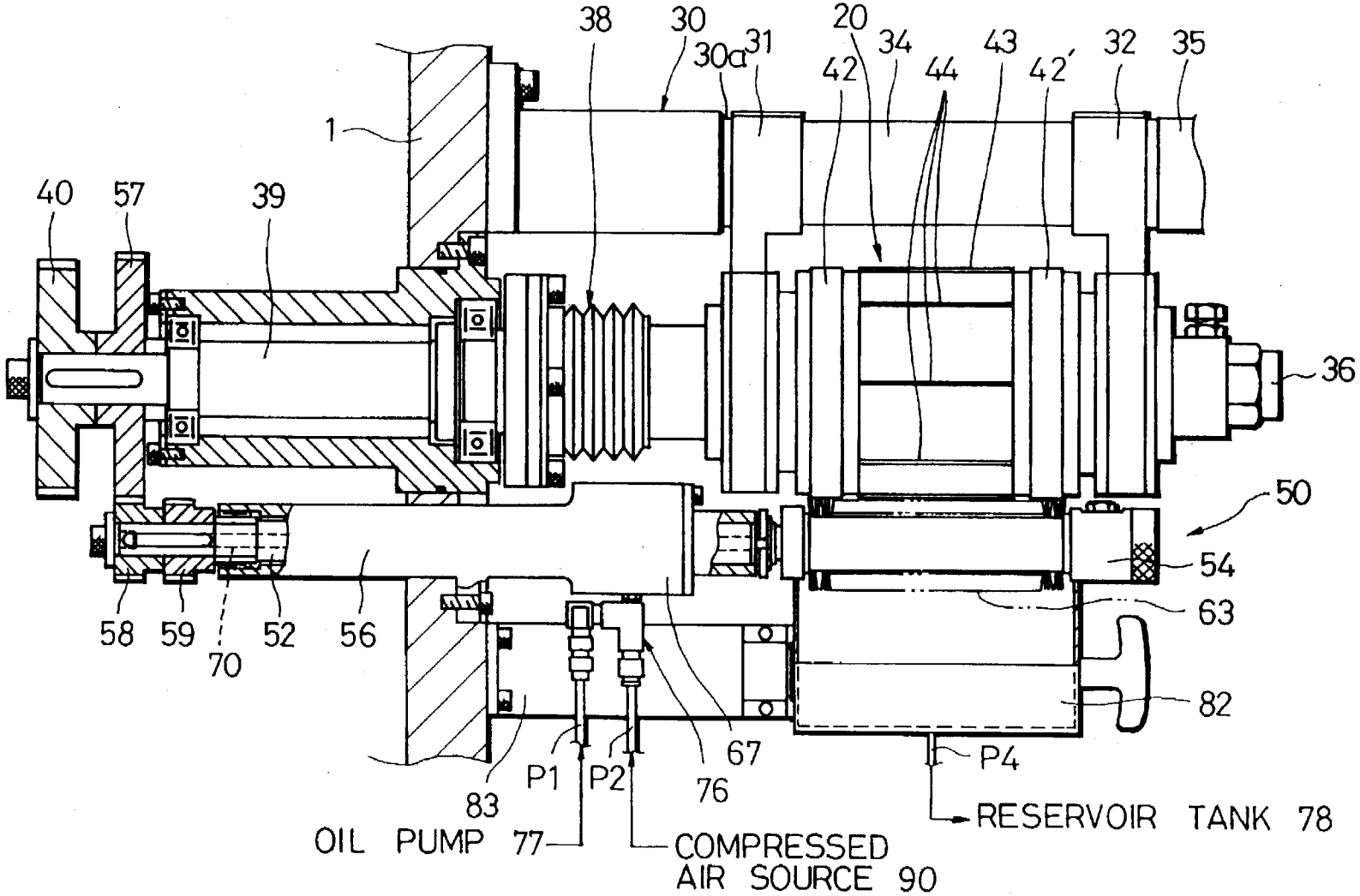
FIG. 4 is a side view of the tip paper cutting apparatus.

As shown in FIGS. 3 and 4, the bladed drum 43 of the unit 20 is mounted on first and second rocking arms 31 and 32 each disposed for rocking motion about a rocking shaft 30, and is held at a suitable position by setting the rocking arms 31 and 32 in a predetermined position.

Specifically, the rocking shaft 30 extends parallel with the receiving drum shaft 23 between the supporting plate 24 and the base frame 1, and has opposite ends supported by the protuberance 24*a* of the supporting plate 24 and the base frame 1, respectively. The upper end portions of the rocking arms 31 and 32 are supported for rocking motion by the rocking shaft 30 through respective bearings (not shown). The rocking arms 31 and 32 are set in their respective required axial positions of the rocking shaft 30 by a shoulder 30*a* formed on an end portion of the rocking shaft 30 close to the base frame 1, a spacer sleeve 34 fitted on a portion of the rocking shaft 30 between the rocking arms 31 and 32, and a spacer ring 35 fitted on a portion of the rocking shaft 30 between the first rocking arm 31 and the supporting plate 24.

A drum shaft 36 on which the bladed drum 43 is mounted is rotatably supported by lower end portions of the first and second rocking arms 31 and 32 through respective bearings (not shown). The drum shaft 36 extends parallel with the receiving drum shaft 23 and has opposite end portions smaller in diameter than a middle portion thereof. The small-diameter end portions extend through respective drum shaft insertion holes (not shown) in the lower end portions of the corresponding rocking arms 31 and 32. The end of the drum shaft 36 close to the base frame 1 is coupled to an inner end of an input shaft 39 via an Oldham coupling 38 mounted to the base frame 1. The input shaft 39 is rotatably supported by the base frame 1 through bearings (not shown). A first input gear 40 and a first output gear 57 are fitted on an outer end portion of the input shaft 39. The first input gear 40 is so constructed as to be rotated by a rotatory driving force transmitted thereto from a gear train, not shown; therefore, as the gear 40 rotates, the drum shaft 36 also rotates.

The Oldham coupling 38 interposed between the input shaft 39 and the drum shaft 36 permits power transmission from the input shaft 39 to the drum shaft 36 even in the case where the axis of the drum shaft 36 supported by the rocking arms 31 and 32 becomes misaligned with the axis of the input shaft 39 due to rocking motion of the arms 31 and 32.

First and second free rollers 42 and 42' are rotatably fitted on the respective small-diameter portions of the drum shaft 36 via bearings, not shown, at locations inward of the opposing surfaces of the corresponding rocking arms 31 and 32. The free rollers 42 and 42' each comprise a roller body made of cemented carbide, and holder rings attached to opposite end faces of the roller body by screws penetrating the roller body (not shown).

The bladed drum 43 is mounted on the middle, large-diameter portion of the drum shaft 36 extending from the inner end face of the first free roller 42 to that of the second free roller 42'. The bladed drum 43 has a drum body made of cemented carbide, and a plurality of cutting blades 44 are arranged on the outer peripheral surface of the drum body at an equal distance from each other in the circumferential direction thereof. The edge of each cutting blade 44 extends in the axial direction of the drum shaft 36. Although not shown, the edge of each cutting blade 44 has a trapezoidal cross-sectional shape suited for cutting the tip paper P without coming into contact with the receiving drum 19.

The aforementioned supporting block 25 is provided with a pair of urging mechanisms (only one of them is shown at 27 in FIG. 3) including springs, air cylinders, etc. for pressing the corresponding rocking arms 31 and 32 toward the receiving drum 19, and accordingly, the free rollers 42 and 42' are brought into rolling contact with the receiving drum 19 with a predetermined force by the corresponding urging mechanisms through the rocking arms 31 and 32.

Each of the free rollers 42 and 42' has an outer diameter slightly greater than the diameter of a locus formed by the edges of the cutting blades 44 rotating together with the bladed drum 43. Consequently, when the outer peripheral surfaces of the free rollers 42 and 42' are brought into rolling contact with the outer peripheral surface of the receiving drum 19, a very small gap (not shown) considerably smaller than the thickness of the tip paper P is defined without fail between the edge of each cutting blade 44 and the outer peripheral surface of the receiving drum 19, thus avoiding contact of the cutting blades 44 with the outer peripheral surface of the receiving drum 19 during rotation of the receiving drum 19 and bladed drum 43.

In addition to the tip paper cutting function described above, the cutting apparatus 18 has the function of applying a paste repellent liquid to the blades 44 of the bladed drum 43.

In connection with this liquid applying function, the cutting apparatus 18 has first and second brush roller assemblies (brush roller means) 50 and 51 (FIG. 3), which are arranged in the vicinity of the bladed drum 43 at a predetermined distance therefrom and adjoin each other for applying a paste repellent liquid, for example, olive oil, to the cutting blades 44. The brush roller assemblies 50 and 51 have substantially the same arrangement; therefore, the following explanation is directed chiefly to the first brush roller assembly 50.

Figure 5:
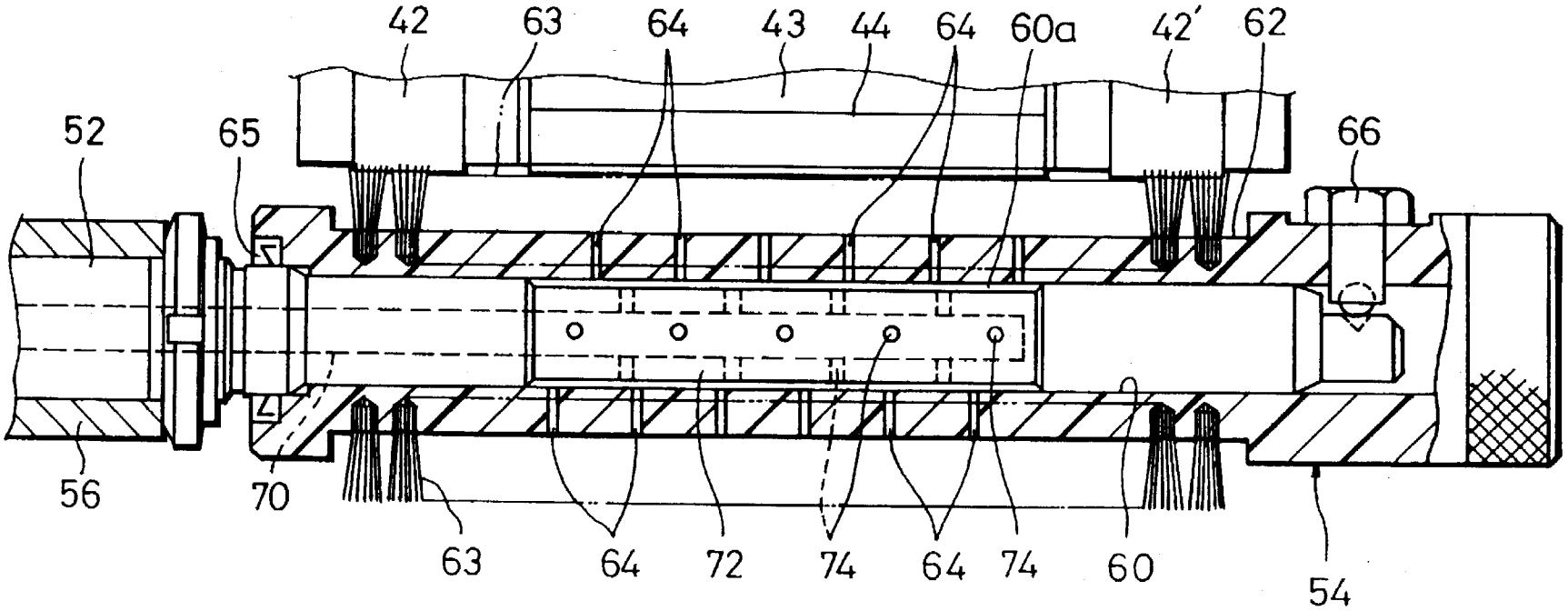
FIG. 5 is a longitudinal sectional view of a brush roller shown in FIG. 4.

The first brush roller assembly 50 has a first brush roller cartridge (hereinafter merely referred to as the first brush roller) 54. As shown in FIG. 5, the first brush roller 54 is a hollow cylindrical member having a bottom at one end, and an axial hole 60 extends from the inner end face to a portion near the outer end face of the brush roller 54 along the axis thereof. Also, the brush roller 54 has a section which is smaller in diameter than opposite end portions thereof and which extends from a region facing the outer end face of the first free roller 42 to a region facing the outer end face of the second free roller 42'. A brush 63 for applying the paste repellent liquid to the cutting blades 44 is formed over the entire peripheral surface of the small-diameter portion 62 of the brush roller 54 so as to be in contact with the cutting blades 44. Since the outer diameter of each of the free rollers 42 and 42' is slightly greater than that of the bladed drum 43, the bristles of the brush 63 formed in the outer peripheral surface regions of the brush roller 54 facing the free rollers 42 and 42' are slightly longer than those formed in the outer peripheral surface region facing the bladed drum 43.

The axial hole 60 of the first brush roller 54 is fitted with a half of a first roller shaft 52 of the first brush roller assembly 50. The first roller shaft 52 is rotatably supported through a bearing by a first cylinder 56 mounted on the base frame 1 and extending parallel with the bladed drum shaft 36. A second input gear 58 and a second output gear 59 are fitted on an end of the roller shaft 52 located opposite the brush roller 54 with respect to the cylinder 56 (FIG. 4). The second input gear 58 is in mesh with the first output gear 57 mounted on the first input shaft 39, and thus the roller shaft 52 is rotated by the rotating force transmitted thereto from the input shaft 39 through the gears 57 and 58.

The brush roller 54 is fixed to the roller shaft 52 by a ball plunger 66 screwed into a threaded hole cut in the peripheral wall of the roller 54; therefore, the brush roller 54 is supported by the roller shaft 52 for rotation together therewith. Thus, the brush roller 54 is formed as a replaceable cartridge detachably mounted to the roller shaft 52. When the brush 63 is worn out, the ball plunger 66 is removed to permit the brush roller 54 to be detached from the roller shaft 52, whereby the brush roller can be replaced with a new one. In FIG. 5, reference numeral 65 denotes a sealing member located at the inner open end of the brush roller 54 between the inner peripheral surface of the roller 54 and the outer peripheral surface of the roller shaft 52.

The second brush roller assembly 51 has a second roller shaft (not shown) and a second brush roller 55 corresponding, respectively, to the first roller shaft 52 and the first brush roller 54, and a brush 63' equivalent to the brush 63 is formed over the outer peripheral surface of the brush roller 55 (FIG. 3). The second roller shaft extends parallel with the first roller shaft 52 and is rotatably supported by a second cylinder (not shown) corresponding to the first cylinder 56. A third input gear (not shown) meshed with the second output gear 59 of the first roller shaft 52 is fitted on the second roller shaft. The second roller shaft is rotated by the rotating force transmitted thereto from the input shaft 39 through the gears 57 and 58, the first roller shaft 52, the gear 59, and the third input gear. The second brush roller 55 is mounted to the second roller shaft so that it may be rotatable together with the roller shaft and at the same time detachable therefrom.

Accordingly, when the rotatory driving force is transmitted from the first input shaft 39 to the first roller shaft 52 through the first output gear 57 and the second input gear 58, the first roller shaft 52 and the second roller shaft rotate in opposite directions, whereby the first and second brush rollers 54 and 55, immovably mounted on the first roller shaft 52 and the second roller shaft, respectively, rotate in opposite directions. Specifically, as shown in FIG. 3, the brush rollers 54 and 55 rotate in respective inward directions such that as the rollers 54 and 55 rotate, corresponding portions of the outer peripheral surfaces of the rollers 54 and 55 approach each other on one side close to the bladed drum 43 with respect to an imaginary plane S containing both the axes of rotation of the rollers 54 and 55, and move away from each other on the other side remote from the drum 43.

In connection with the supply of the paste repellent liquid to the brushes 63 and 63', the cutting apparatus 18 has first and second passages formed in the first and second brush roller assemblies 50 and 51, respectively, and supply means for supplying the paste repellent liquid, for example, olive oil, to the passages. The first and second passages have an identical arrangement, and therefore, the following description is focused on the first passage and a part of the supply means relating to the first passage.

As shown in FIGS. 3 and 5, the first passage is composed of a plurality of discharge holes 64 formed in the first brush roller 50, and, in relation to the first passage, the supply means includes an axial hole 70 and communication holes **73*a* and 74 formed in the first roller shaft 52. The olive oil fed into the first passage (discharge holes 64) from the supply means is supplied toward the brush 63**.

More specifically, the axial hole 70 extends along the axis of the roller shaft 52 from the end of the roller shaft 52 remote from the brush roller 54 to a portion of the roller shaft 52 corresponding in position to the end face of the second free roller 42' of the bladed drum 43. An end of the axial hole 70 remote from the brush roller 54 is closed by a screw or the like.

The communication holes **73*a*, which are four in number, for example, are formed in the large-diameter portion 73 of the roller shaft 52 at the same location with respect to the axial direction of the shaft 52 equidistantly in the circumferential direction thereof and extend in the radius direction of the roller shaft 52. Around the portion of the roller shaft 52 axially adjacent to the communication holes 73*a* are fitted a pair of sealing members 71 and 71' so as to intervene between the inner peripheral surface of a large-diameter portion 67 of the cylinder 56 and the outer peripheral surface of the large diameter portion 73 of the roller shaft 52. Thus, an annular space 67*a* (FIG. 6) is defined by the sealing members 71 and 71', the inner peripheral surface of the cylinder large-diameter portion 67 and the outer peripheral surface of the large-diameter portion 73 of the roller shaft. Each communication hole 73*a* has a radially inward end opening in the inner peripheral surface of the roller shaft 52 (the surface defining the axial hole 70) to be in communication with the axial hole 70, and has a radially outward end opening in the outer peripheral surface of the large-diameter portion 73 of the roller shaft 52 to be in communication with the annular space 67*a***.

The communication holes 74 are formed in a section of the roller shaft 52 facing the outer peripheral surface of the bladed drum 43 and located at predetermined distances from each other in the circumferential and axial directions of the roller shaft 52. This section of the roller shaft 52 has an outer diameter smaller than the diameter of the axial hole 60, thus providing an annular space **60*a* (FIG. 5) defined between the outer peripheral surface of the roller shaft 52 and the inner peripheral surface of the brush roller 54 (the surface defining the axial hole 60). Each communication hole 74 has a radially inward end opening in the inner peripheral surface of the peripheral wall of the roller shaft 52 (the surface defining the axial hole 70) to be in communication with the axial hole 70, and has a radially outward end opening in the outer peripheral surface of the peripheral wall of the roller shaft 52 to be in communication with the annular space 60*a***.

The discharge holes 64 are formed in a section of the brush roller 50 facing the outer peripheral surface of the bladed drum 43 and located at predetermined distances from each other in the circumferential and axial directions of the brush roller 50. Each discharge hole 64 has a radially inward end opening in the inner peripheral surface of the peripheral wall of the brush roller 50 (the surface defining the axial hole 60) to be in communication with the annular space **60*a*, and has a radially outward end 64*a* as an olive oil discharge port opening in the outer peripheral surface of the brush roller 50**.

The second passage and the part of the olive oil supplying means associated therewith have arrangements identical to those of the first passage and the associated part of the supplying means; therefore, description thereof is omitted.

The olive oil supply means of this embodiment is designed to supply atomized olive oil to the first and second passages. In connection with the first passage, the olive oil supply means has a supply port 75 (FIG. 6) formed in the large-diameter portion 67 of the cylinder and the below-mentioned various elements for supplying olive oil thereto, in addition to the axial hole 70 and the communication holes **73*a*, 74. The supply port 75 extends through the peripheral wall of the cylinder large-diameter portion 67 in the radius direction of the roller shaft 52 and communicates with the aforementioned annular space 67*a*. The annular space 67*a* is, on the other hand, connected to the axial hole 70 through the communication holes 73*a***.

Figure 6:
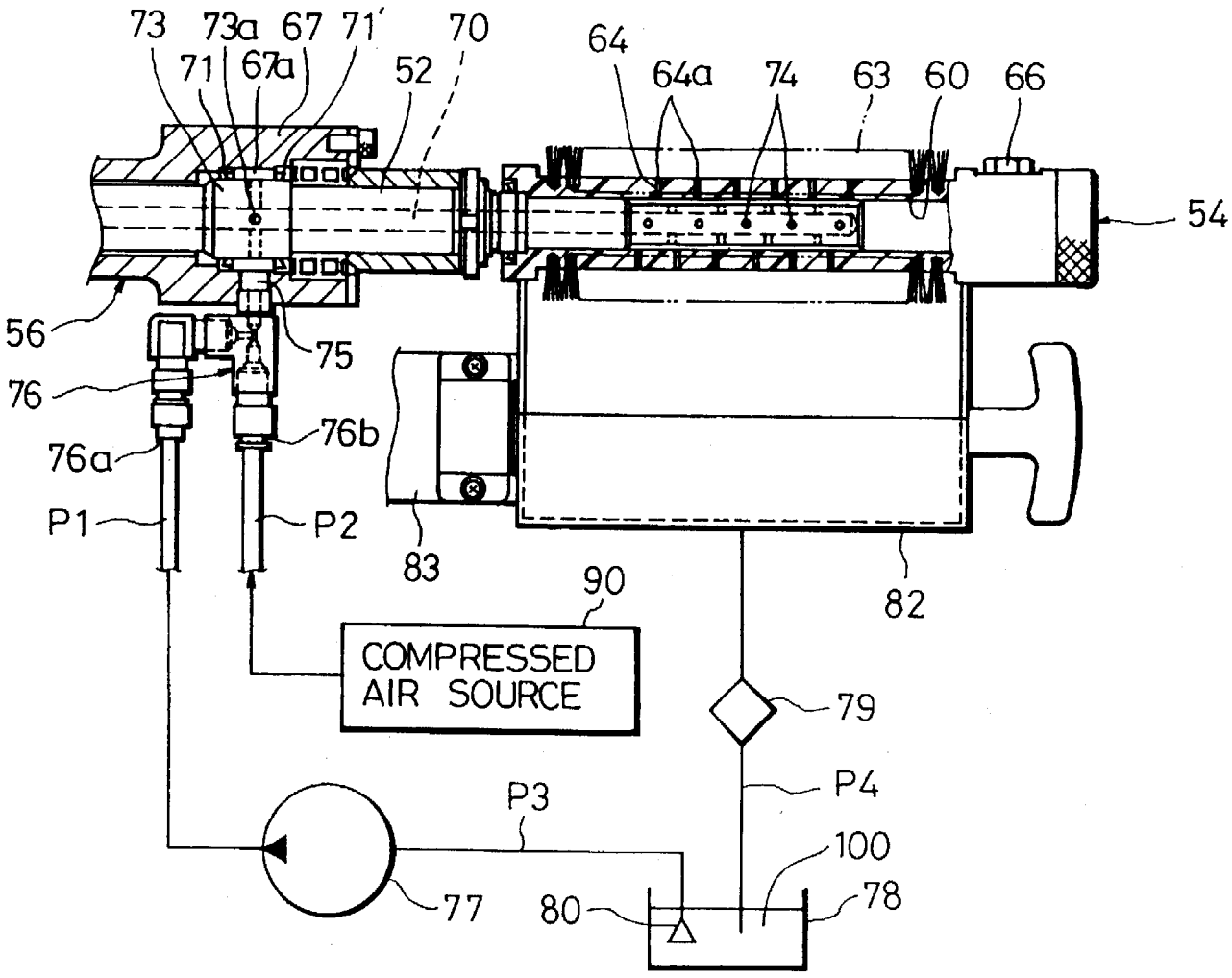
FIG. 6 is a diagram showing, partly in section, an olive oil supply system of the tip paper cutting apparatus.

The olive oil supply means has a spraying device 76, which is connected to the input side of the supply port 75 and includes an atomizer for atomizing olive oil by means of compressed air before the supply of olive oil, and other elements. The spraying device 76 has a first input port **76*a* connected to the discharge port of an oil pump 77 through a pipe P1, and has a second input port 76*b* connected to a compressed air source 90 through a pipe P2. The suction port of the oil pump 77 is connected to a reservoir tank 78** through a pipe P3. Olive oil 100 as the paste repellent liquid is stored in the reservoir tank 78. In FIG. 6, reference numeral 80 denotes a strainer.

In connection with the second passage, the olive oil supplying means is provided with a supply port, spraying device and pipes (none of which are shown) corresponding to the elements 75, 76 and P1 to P3 associated with the first passage.

The cutting apparatus 18 further comprises recovery means for collecting olive oil scattered from the brushes 63 and 63' with rotation of the brush rollers 54 and 55. Specifically, as shown in FIGS. 3 and 4, a collecting pan 82 for receiving olive oil scattered from the brushes 63 and 63' is arranged on the side of the brush roller assemblies 50 and 51 opposite to the bladed drum 43 so as to face the brush rollers 54 and 55. The collecting pan 82 is mounted to an arm 83 (FIG. 6) extending from the base frame 1, and has a bottom connected to the reservoir tank 78 through a pipe P4. The pan 82 has a spray guard wall 84 extending around the brushes 63 and 63' of the brush rollers 54 and 55 up to a location close to the bladed drum 43. Namely, the collecting pan 82 and the spray guard wall 84 surround the whole of the side of the brush rollers 54 and 55 remote from the bladed drum 43 and part of the side of the rollers 54 and 55 close to the bladed drum 43.

To remove extraneous matter mixed into the olive oil, a relatively coarse filter mesh (not shown) is arranged at the bottom of the pan 82, and also an oil filter 79 (FIG. 6) is provided in the middle of the pipe P4.

The operation of the olive oil supply means of the cutting apparatus 18 and peripheral elements thereof will be now explained.

During operation of the cigarette manufacturing system, the olive oil 100 in the reservoir tank 78 is drawn up by the oil pump 77, and the pressurized olive oil is supplied to the spraying device 76 associated with the first passage, as well as to the spraying device (not shown) associated with the second passage.

In the spraying device 76, olive oil is atomized by means of compressed air supplied thereto from the compressed air source 90. The olive oil thus atomized flows through the supply port 75 associated with the first passage into the annular space 67*a* between the cylinder large-diameter portion 67 and the large-diameter portion 73 of the roller shaft. The atomized olive oil then flows into the annular space 60*a* between the first roller shaft 52 and the first brush roller 54 through the communication holes 73*a*, axial hole 70 and communication holes 74 formed in the first roller shaft 52. Subsequently, the atomized olive oil in the annular space 60*a* is sprayed toward the brush 63 of the first brush roller 54 from the discharge ports (spray ports) 64*a* of the discharge holes 64 opening in the outer peripheral surface of the brush roller 54 and communicating with the annular space 60*a*. As in the case of the first passage, atomized olive oil is supplied to the second passage and sprayed toward the brush 63' of the second brush roller 55 from discharge ports (not shown) associated with the second passage.

The olive oil sprayed from the discharge ports is subjected to the centrifugal force produced due to rotation of the brush roller 54, 55; therefore, the olive oil scatters in the radially outward direction of the brush roller. When olive oil scatters, it passes through the brushes 63 and 63', and accordingly, the brushes 63 and 63' can be sufficiently soaked with olive oil even during high-speed rotation of the brush rollers 54 and 55. Consequently, the cutting blades 44 are reliably applied with olive oil by means of the brushes 63 and 63', thus reliably preventing the cutting blades 44 from being encrusted with paste. Therefore, good cutting quality of the blades 44 can be maintained, and defective supply of the tip paper and consequent inconveniences can be prevented.

Further, olive oil scattered from the brushes 63 and 63' with rotation of the brush rollers 54 and 55 collides with the collecting pan 82 or the spray guard wall 84, toward which the olive oil scatters, and is collected directly by the pan 82 or drips down into the collecting pan 82 along the inner surface of the wall 84. Coarse extraneous matter mixed into the olive oil is removed by the filter mesh arranged at the bottom of the collecting pan 82, and the olive oil is then returned to the reservoir tank 78 through the pipe P4. While the olive oil returns to the tank 78, extraneous matter is removed also by the oil filter 79 arranged in the middle of the pipe P4. The olive oil thus returned to the reservoir tank 78 is again drawn up by the oil pump 77 and reused.

As mentioned above, since the scattering of olive oil is blocked, the quality of cigarette products is in no way damaged by scattered olive oil. Further, the collected olive oil is reused, and therefore, the consumption of expensive olive oil can be minimized.

The present invention is not limited to the above embodiment, and various modifications are possible.

For example, in the above embodiment, the brush roller is composed of the roller shaft 52 and the brush roller cartridge 54 (55) detachably fitted on the roller shaft 52. It is, however, not essential to employ a cartridge-type brush roller, and the brush roller and the roller shaft may be formed as a one-piece unit.

Further, although in the embodiment previously atomized olive oil is used as the paste repellent liquid, a paste repellent liquid other than olive oil may be used, and it is not essential to atomize the paste repellent liquid. It is also not essential to provide the cutting apparatus with the recovery means for collecting the paste repellent liquid.

In the foregoing embodiment, the brush rollers 54 and 55 are rotated by the bladed drum 43 in inward and opposite directions. However, the brush rollers 54 and 55 may be rotated by a driving source separate from that associated with the bladed drum, and the rollers 54 and 55 may be rotated in directions different from the illustrated directions.

Furthermore, although the above embodiment of the invention is applied to the non-contact type cutting apparatus in which the cutting blades 44 of the bladed drum 43 do not come into contact with the receiving drum 19, the present invention can be applied to a contact-type cutting apparatus.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A tip paper cutting apparatus for a filter cigarette manufacturing system, in which tip paper fed in between a receiving drum and a bladed drum is cut into pieces by cutting blades arranged on an outer peripheral surface of the bladed drum, the tip paper cutting apparatus comprising brush roller means which include:

a brush roller rotatably arranged close to the bladed drum and having an outer peripheral surface and a longitudinal axis, the brush roller having a first axial hole formed therein extending along the longitudinal axis of the brush roller, a plurality of discharge holes being formed in the brush roller, each of the discharge holes having a discharge port opening in the outer peripheral surface of the brush roller, the discharge holes each having a discharge axis which is nonparallel to the longitudinal axis of the brush roller;

a brush mounted on the outer peripheral surface of the brush roller;

a roller shaft fitted into the first axial hole of the brush roller, the roller shaft having a longitudinal axis and having a second axial hole formed therein extending along the longitudinal axis of the roller shaft, the roller shaft having at least one communication hole having a discharge axis extending in a radial direction of the roller shaft;

the discharge axis of each of the discharge holes being nonaligned and offset from the discharge axis of the at least one communication hole;

an annular space formed between the brush roller and the roller shaft, the at least one communication hole and the discharge holes being in communication with the annular space, the annular space extending along the longitudinal axes of the brush roller; and a passage formed in the brush roller means for receiving a paste repellent liquid, the passage including the plurality of discharge ports and discharge holes in the brush roller, the annular space, the at least one communication hole of the roller shaft and the second axial hole whereby paste repellent liquid can flow through the second axial hole of the roller shaft, through the at least one communication hole, through the annular space, through the plurality of discharge holes and then out of the discharge ports to the brush.

2. The tip paper cutting apparatus according to claim 1, wherein each of the discharge holes of the brush roller extend from the discharge port to the annular space and a circumference of each of the discharge holes is uniform and constant from the discharge ports to the annular space and wherein the annular space has a uniform diameter and opens directly to the discharge holes.

3. The tip paper cutting apparatus according to claim 1, wherein the brush roller is a solid, one-piece member with the discharge holes extending through the brush roller.

4. The tip paper cutting apparatus according to claim 1, further comprising supply means for supplying paste repellant liquid to the passage of the brush roller means.

5. The tip paper cutting apparatus according to claim 4, wherein the supply means has an outlet and wherein the apparatus further comprises sealing means between the supply means and the brush roller means for sealing the outlet of the supply means to the brush roller means.

6. The tip paper cutting apparatus according to claim 4, wherein said supply means includes a tank for storing paste repellent liquid, a pipe connecting the tank to the passage of the brush roller means, and a pump arranged in the pipe for feeding paste repellent liquid in the tank into the passage under pressure.

7. The tip paper cutting apparatus according to claim 6, wherein said supply means further includes atomizing means for atomizing paste repellent liquid, the atomizing means including:

a compressed air source for supplying compressed air;

a second pipe extending from the compressed air source; and a spraying device arranged in the pipe of the supply means on a downstream side of the pump and connected to the compressed air source through the second pipe, said spraying device atomizing paste repellent liquid supplied thereto under pressure from the pump through the pipe of said supply means by utilizing compressed air from the compressed air source.

8. The tip paper cutting apparatus according to claim 6, wherein the roller shaft is rotatable and has at least one hole for communication between the second axial hole and the spraying device, the at least one hole between the axial hole and the spraying device being rotatable with the roller shaft and having an axis generally perpendicular to the longitudinal axis of the roller shaft.

9. The tip paper cutting apparatus according to claim 8, further comprising sealing means adjacent the at least one hole between the second axial hole and the spraying device for sealing an outlet of the spraying device to the brush roller means.

10. The tip paper cutting apparatus according to claim 4, wherein said supply means includes atomizing means for atomizing paste repellent liquid before discharge from the plurality of discharge ports of the passage of said brush roller means.

11. The tip paper cutting apparatus according to claim 1, wherein said brush roller means includes a pair of brush rollers located adjacent to each other, said pair of brush rollers being rotatable in opposite directions, each of the brush rollers being rotatable about a rotational axis with a plane passing through the rotational axes, peripheral surfaces of the brush rollers on a side of the plane close to the bladed drum approach each other when the brushes are rotated.

12. The tip paper cutting apparatus according to claim 11, further comprising recovery means for collecting paste repellent liquid scattered from the brushes during rotation of the pair of brush roller, the recovery means including:

a collecting pan arranged on one side of said pair of brush rollers opposite to the bladed drum; and a spray guard wall attached to the collecting pan, said spray guard wall surrounding at least another side of said pair of brush rollers and being located opposite to the bladed drum with respect to the plane passing through the rotational axes.

13. The tip paper cutting apparatus according to claim 12, wherein the spray guard wall extends around the brushes up to a location close to the bladed drum.

14. The tip paper cutting apparatus according to claim 1, further comprising recovery means for collecting paste repellent liquid scattered from the brush during rotation of the brush roller.

15. The tip paper cutting apparatus according to claim 14, wherein the recovery means comprises:

a collecting pan arranged on one side of the brush roller opposite to the bladed drum; and a spray guard wall attached to the collecting pan, said spray guard wall surrounding at least another side of said brush roller and extending up to a location close to the bladed drum.

16. The tip paper cutting apparatus according to claim 1, wherein the brush is in contact with the cutting blades and wherein the plurality of discharge holes are distributed along a length of the brush roller and around a circumference of the brush roller.

17. The tip paper cutting apparatus according to claim 1, wherein the at least one communication hole of the roller shaft comprises a plurality of holes with each communication hole having a discharge axis, the discharge axes of the communication holes being nonaligned with the discharge axes.

* * * * *